US006146190A

United States Patent [19]

Fuerst et al.

[11] Patent Number: 6,146,190

[45] Date of Patent: Nov. 14, 2000

[54] ELECTRICAL CONNECTOR ASSEMBLY FOR CONNECTING FLAT FLEXIBLE CIRCUITRY TO DISCRETE ELECTRICAL TERMINALS

[75] Inventors: Robert M. Fuerst, Maple Park; Yves LePottier, Geneva; Russell J. Watt, Chicago, all of Ill.

[73] Assignee: Molex Incorporated, Lisle, Ill.

[21] Appl. No.: 09/088,151

[22] Filed: Jun. 1, 1998

[51] Int. Cl.[7] ..... H01R 23/66

[52] U.S. Cl. ..... 439/496

[58] Field of Search ..... 439/495, 496, 439/492

[56] References Cited

U.S. PATENT DOCUMENTS

| | | | |
|---|---|---|---|
| 3,602,870 | 8/1971 | Willard | 439/74 |
| 3,713,073 | 1/1973 | Narozny | 439/456 |
| 3,825,878 | 7/1974 | Finger et al. | 439/493 |
| 4,802,866 | 2/1989 | Balzano et al. | 439/496 |
| 5,299,954 | 4/1994 | Ishii | 439/422 |
| 5,356,308 | 10/1994 | Toba et al. | 439/495 |
| 5,383,788 | 1/1995 | Spencer | 439/67 |
| 5,397,247 | 3/1995 | Aoki et al. | 439/495 |
| 5,403,202 | 4/1995 | Roehling | 439/496 |
| 5,529,502 | 6/1996 | Peltier et al. | 439/67 |
| 5,620,329 | 4/1997 | Kidd et al. | 439/248 |

FOREIGN PATENT DOCUMENTS

WO 97/29526 8/1997 WIPO .

*Primary Examiner*—Brian Sircus
*Assistant Examiner*—Eugene G. Byrd
*Attorney, Agent, or Firm*—Stacey E. Caldwell

[57] ABSTRACT

An electrical connector assembly is provided for interconnecting a plurality of discrete electrical wires to the conductors of a flat flexible circuit. The assembly includes a first connector having a dielectric housing. A plurality of discrete conductive terminals are mounted on the housing and are adapted for termination to the electrical wires. The terminals have contact portions for engaging the conductors of the flat flexible circuit. A second connector is adapted for mating with the first connector. The second connector includes a body member for positioning the flat flexible circuit, with the conductors of the circuit positioned for engaging the conductive terminals when the connectors are mated. A yieldable backing structure is provided on the body member beneath the flexible circuit for resiliently biasing the conductors of the circuit against the terminals of the first connector.

20 Claims, 4 Drawing Sheets

ELECTRICAL CONNECTOR ASSEMBLY FOR CONNECTING FLAT FLEXIBLE CIRCUITRY TO DISCRETE ELECTRICAL TERMINALS

FIELD OF THE INVENTION

This invention generally relates to the art of electrical connectors and, particularly, to connectors for electrically interconnecting a plurality of discrete electrical wires to conductors of a flat flexible circuit.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of connectors have been designed over the years for terminating or interconnecting flat flexible circuits with complementary mating connecting devices. However, there has not been a reliable and cost effective system for electrically connecting a plurality of discrete electrical wires to flat flexible circuitry. Part of the problem resides in the fact that the terminals must somehow be biased against the flat circuitry. The present invention is directed to satisfying that need and solving the problems associated therewith. The present invention is extremely simple, inexpensive and reliable.

SUMMARY OF THE INVENTION

An object, therefore, of the invention is to provide a new and improved electrical connector assembly for interconnecting a plurality of discrete electrical wires to the conductors of a flat flexible circuit.

In the exemplary embodiment of the invention, the connector assembly includes a female connector having a dielectric housing defining a receptacle. A plurality of discrete conductive terminals are mounted on the housing and are adapted for termination to the electrical wires. The terminals have contact portions exposed in the receptacle for engaging the conductors of the flat flexible circuit.

A male connector includes a body portion adapted for insertion into the receptacle of the housing of the female connector. The body portion is adapted for positioning the flat flexible circuit thereon, with the conductors of the circuit facing away from the body portion for engaging the contact portions of the conductive terminals when the body portion is inserted into the receptacle.

The invention contemplates the use of a yieldable backing structure on the body portion of the male connector beneath the flexible circuit for resiliently biasing the conductors of the circuit against the terminals of the female connector. Therefore, the terminals can be maintained rigid on the body portion of the male connector. Preferably, the yieldable backing structure is a molded-in-place component. The body portion may be molded of plastic material and the molded-in-place component may be of an elastomeric material. For instance, the body portion may be molded of relatively rigid plastic material, and the molded-in-place component may be of silicone rubber material.

As disclosed herein, the dielectric housing of the female connector is a multi-part assembly including at least a base part mounting the terminals and a cover part for clamping the male connector and, thereby, the conductors of the flexible circuit against the terminals. Preferably, complementary interengaging latch means are provided between the base part and the cover part to hold the parts in clamping condition. As disclosed herein, the latch means include at least one flexible arm on one of the parts engageable with a latch surface on the other part.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
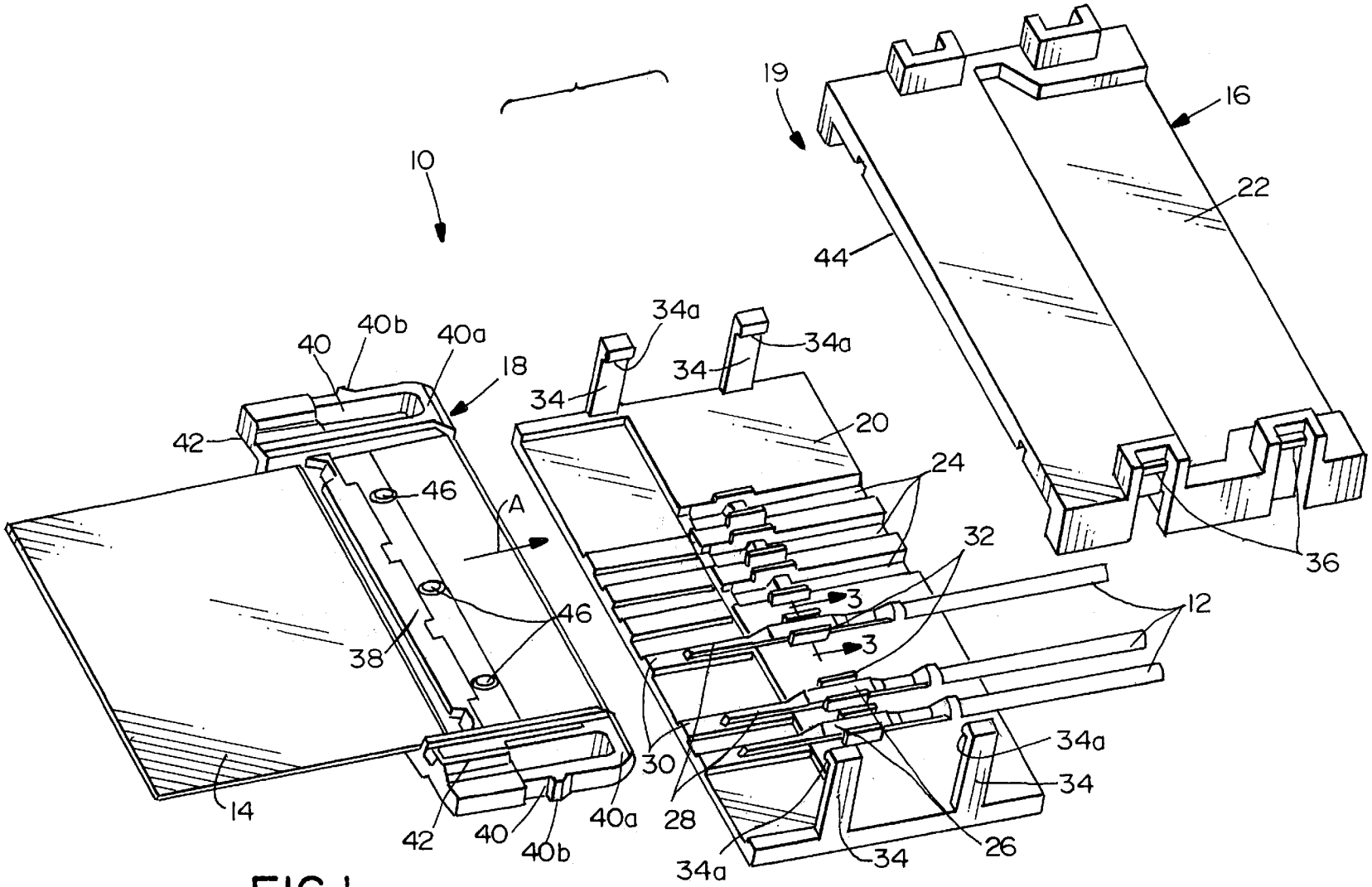
FIG. 1 is an exploded perspective view of the electrical connector assembly for interconnecting a plurality of discrete electrical wires to the conductors of a flat flexible circuit.

Referring to the drawings in greater detail, and first to FIG. 1, the invention is embodied in an electrical connector assembly, generally designated 10, for interconnecting a plurality of discrete electrical wires 12 to the conductors of a flat flexible circuit 14. The connector assembly includes a female connector, generally designated 16, and a male connector, generally designated 18.

More particularly, female connector 16 includes a dielectric housing, generally designated 19, which is a two-part assembly including a base part 20 and a cover part 22. Each part is generally planar whereby the two-part housing clamps male connector 18 between the base part and cover part, as described hereinafter. Each housing part 20 and 22 is a one-piece structure unitarily molded of dielectric material such as plastic or the like. The dielectric housing of the female connector may be fabricated of a one-piece unitarily molded housing whereby the two pieces of the housing are integrally attached by a living hinge or other connecting region to facilitate fabrication and form or mold the part in a single molding process.

Base part 20 of housing assembly 19 includes a plurality of channels 24 for receiving a plurality of discrete conductive terminals 26. Only four of the terminals are shown in FIG. 1, although more terminals are contemplated. The terminals may be of different configurations and sizes to accommodate various applications and various flat flexible circuits, as discussed further below. Rear ends of the terminals are electrically terminated to discrete electrical wires 12. Front ends of the terminals define contact portions 28 which rest on top of a front ledge 30 of housing part 20 which acts as an anvil for the contact portions. The terminals are held on top of the base part by press fits between L-shaped upstanding partitions 32.

Figure 2:
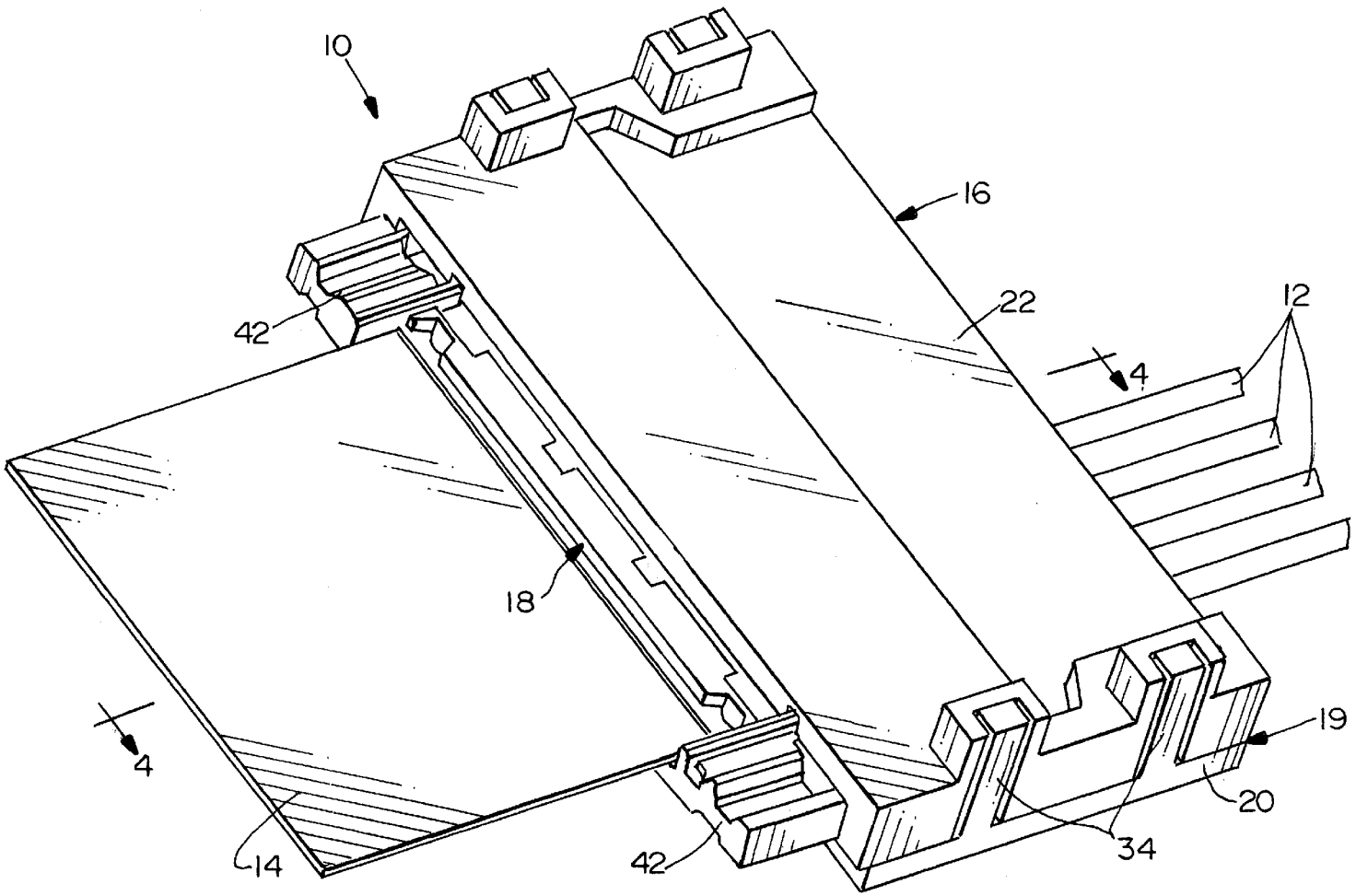
FIG. 2 is a perspective view of the connector assembly in fully closed and mated condition.
Figure 3:
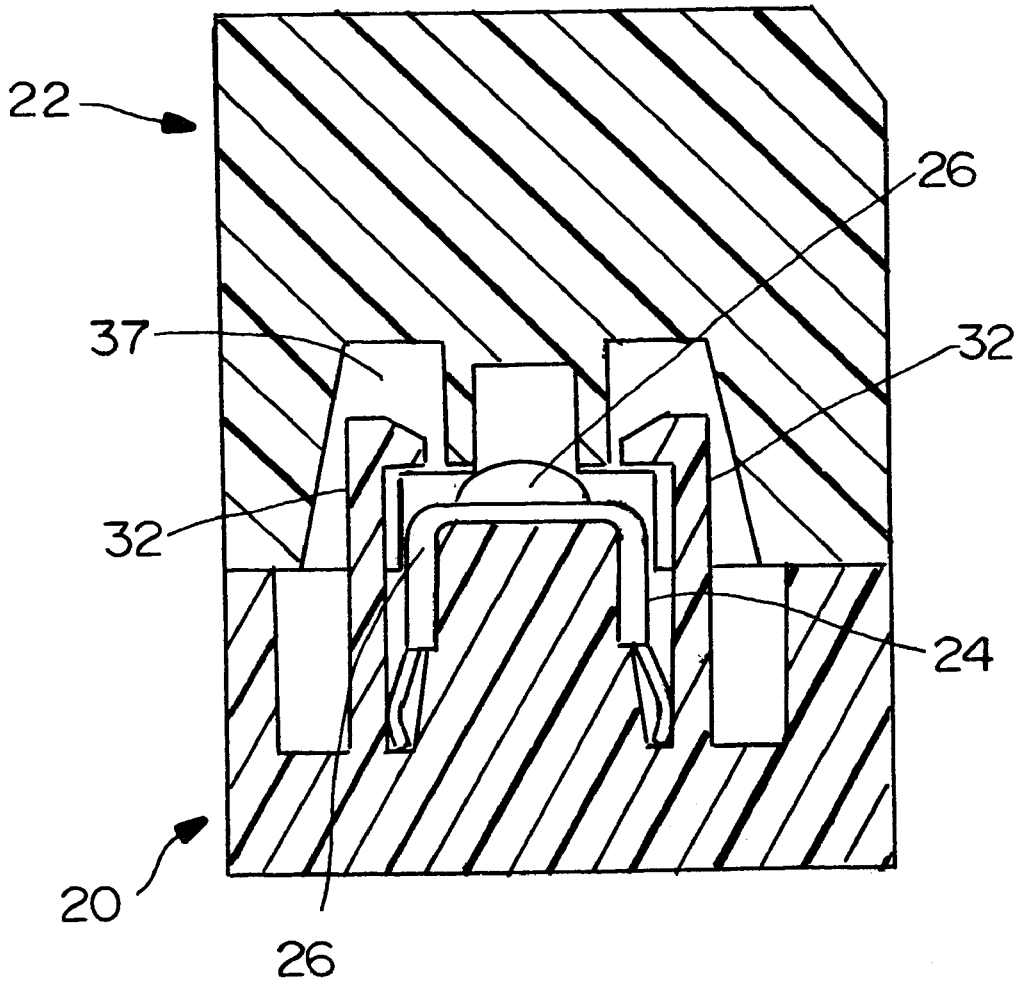
FIG. 3 is a vertical section taken generally along line 3—3 of FIG. 1, but with the base part and the cover part of the female connector in their closed position.

Generally, complementary interengaging latch means are provided between base part 20 and cover part 22 of the two-part housing 19 of female connector 16. Specifically, a pair of flexible latch arms 34 project upwardly from each opposite side of base part 20. The distal ends of the flexible latch arms are provided with inwardly directed hook portions 34*a*. Cover part 22 includes a pair of outwardly directed flanges 36 at each opposite side thereof which define latch surfaces for engagement beneath hook portions 34*a* of flexible latch arms 34. Therefore, the two-parts of housing 19 of female connector 16 are relatively movable between open positions shown in FIG. 1 and closed positions shown in FIG. 2, with latch arms 34 and latch surfaces 36 interengaging to hold the housing parts in their closed positions. The closed positions of the housing parts define a clamping condition of female connector 16 about male connector 18, as will be seen hereinafter. Another feature of the two-part female housing is shown in FIG. 3, showing a cross-sectional view of the female housing in its closed position taken generally along lines 3—3 in FIG. 1 (but with the base part and the cover part in their assembled condition as in FIG. 2). As can be seen in this view, if terminal 26 is not properly positioned within its respective channel 24, upstanding partitions 32 will not fit within corresponding partition channels 37 and cover part 22 will not easily latch onto base part 20. In this way, upstanding partitions 32 and corresponding partition channels 37 function as a terminal position assurance feature for the female connector 16.

Looking again to FIG. 1, male connector 18 of connector assembly 10 includes a body portion 38 about which flat flexible circuit 14 is wrapped. The male body portion is generally flat and elongated and includes a pair of cantilevered latch arms 40 at opposite sides thereof. The body portion, along with the latch arms, is unitarily molded of relatively rigid dielectric material such as plastic or the like. Cantilevered latch arms 40 are joined to body portion 38 at proximal ends 40*a* of the latch arms. The free ends of the latch arms are joined to the body portion by resilient webs 42. The latch arms have outwardly directed latch hooks 40*b* for snapping behind a portion of the female housing, such as front flexible latch arms 34 at opposite sides of base part 20, to hold male connector 18 within female connector 16.

Figure 4:
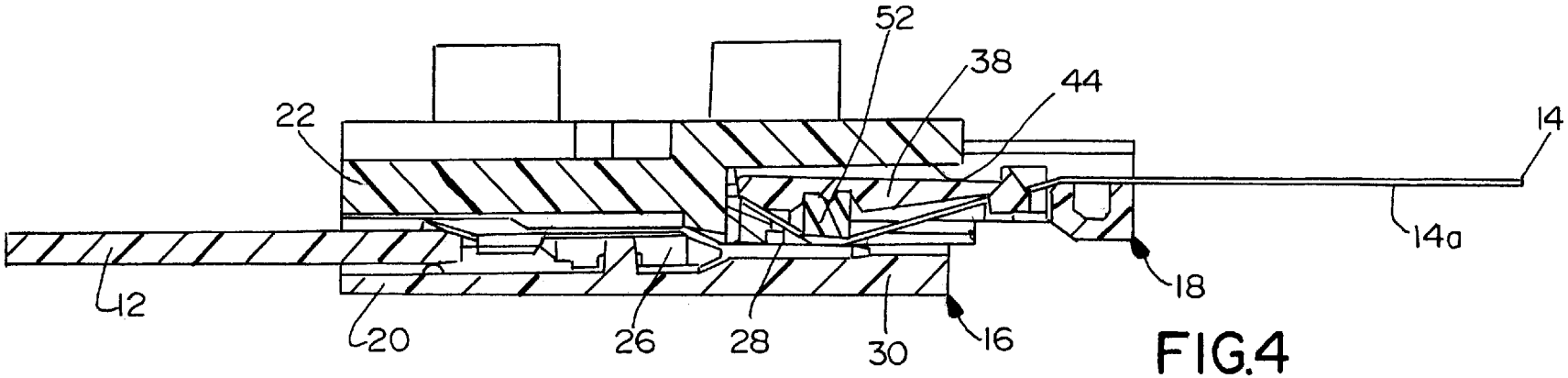
FIG. 4 is a vertical section taken generally along line 4—4 of FIG. 2.

Male connector 18 for flexible circuit 14 is inserted into female connector 16 for discrete electrical wires 12 in the direction of arrow "A" (FIG. 1). FIGS. 2 and 4 show the male connector fully inserted into the female connector. The two housing parts of the female connector define a receptacle 44 for receiving the male connector. When the connectors are fully mated, the conductors on a bottom side 14*a* (FIG. 4) of flat flexible circuit 14 are biased against contact portions 28 of terminals 26 which are terminated to discrete electrical wires 12.

Figure 5:
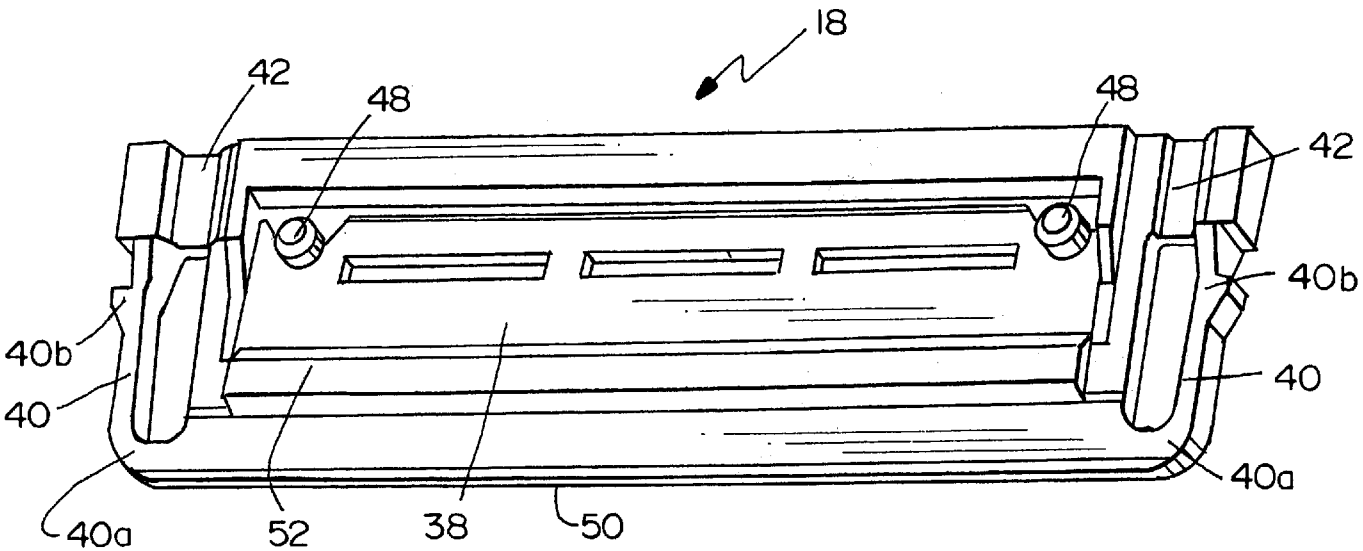
FIG. 5 is a perspective view of the underside of the male connector as viewed in FIG. 1.

Referring to FIG. 5 in conjunction with FIG. 1, body portion 38 of the male connector includes a plurality of locating pegs 46 (FIG. 1) on the top thereof and a plurality of locating pegs 48 (FIG. 5) on the bottom thereof. When flexible circuit 14 is wrapped about a leading edge 50 (FIG. 5), the circuit is located about body portion 38 by appropriate locating holes in the circuit which engage about the locating pegs on opposite sides of body portion 38 of the male connector.

Referring to FIG. 5 in conjunction with FIG. 4, a yieldable backing structure in the form of an elongated strip 52 is provided on the underside of body portion 38 of male connector 18 for resiliently biasing the conductors of flexible circuit 14 against contact portions 28 of the terminals as described above in relation to FIG. 4. The yieldable backing structure or strip can be a molded-in-place component of elastomeric material such as silicone rubber or the like. In other words, body portion 38 of the male connector may be molded of relatively rigid plastic material, while yieldable backing strip 52 is molded of elastomeric material. Since the elastomeric material extends continuously along the width of the male connector, the flexible circuit may be provided with any of a variety of widths or sizes of conductors which will be uniformly biased against corresponding contact portions in the female connector. Accordingly, the widths and the layout of the flexible circuit traces and the contact portions 28 must be coincidental, however such flexibility and variety is easily accommodated in the present design. With this structural combination, as clearly seen in FIG. 4, the resilient backing strip lies behind flexible circuit 14 and biases the outwardly facing conductors of the circuit against contact portions 28 of terminals 26, while ledge portion 30 of base housing part 20 of the female connector acts as an anvil behind the contact portions of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for interconnecting a plurality of discrete electrical wires to the conductors of a flat flexible circuit, comprising:

a female connector including a dielectric housing defining a receptacle, and a plurality of discrete conductive terminals mounted on the housing and adapted for termination to said electrical wires with the terminals having contact portions exposed in said receptacle for engaging the conductors of the flat flexible circuit; and a male connector including a body portion for insertion into the receptacle of the housing of the female connector, the body portion being adapted for positioning the flat flexible circuit thereon with the conductors of the circuit positioned for engaging said conductive terminals when the body portion is inserted into the receptacle, wherein the body portion includes integral locating pegs adapted to engage corresponding locating holes in the flat flexible circuit for locating the flat flexible circuit relative to the body portion and a yieldable backing structure on the body portion beneath the flexible circuit for resiliently biasing the conductors of the circuit against the terminals of the female connector.

2. The electrical connector assembly of claim 1 wherein said housing of said female connector includes an anvil portion at a front ledge thereof for rigidly backing the contact portions of the terminals.

3. The electrical connector assembly of claim 1 wherein said yieldable backing structure is a molded-in-place component.

4. The electrical connector assembly of claim 3 wherein said body portion is molded of plastic material and said molded-in-place component is of an elastomeric material.

5. The electrical connector assembly of claim 4 wherein said body portion is molded of relatively rigid plastic material.

6. The electrical connector assembly of claim 4 wherein said molded-in-place component is of silicone rubber material.

7. The electrical connector assembly of claim 1 wherein said dielectric housing of the female connector is a multi-part assembly including at least a base part mounting the terminals and a cover part removably fixed to the base part wherein the base part and the cover part include complementary interengaging latch means to hold the base and cover parts in their fixed condition.

8. The electrical connector assembly of claim 7, wherein portions of the base part and cover part comprise a terminal position feature which allows the cover part to be fixed easily to the base part only when the terminals are correctly mounted in the base part.

9. The electrical connector assembly of claim 7 wherein said latch means include at least one flexible latch arm on one of the base and cover parts engageable with a latch surface on the other part.

10. The electrical connector assembly of claim 1 wherein said housing is a multi-part assembly including at least a pair of housing parts relatively movable between open and closed positions to facilitate easy insertion of the male connector into the housing of the female connector when the parts are in open condition.

11. The electrical connector assembly of claim 10, including complementary interengaging latch means between the housing parts to hold the housing parts in a clamping condition with respect to the male connector and, thereby, bias the conductors of the flexible circuit against the terminals.

12. The electrical connector assembly of claim 1, including latch means on the male connector for holding the male connector in the receptacle of the female connector.

13. An electrical connector assembly for interconnecting a plurality of discrete electrical wires to the conductors of a flat flexible circuit, comprising:

a first connector including a dielectric housing, and a plurality of discrete conductive terminals mounted on said housing and adapted for termination to said electrical wires with the terminals having contact portions for engaging the conductors of the flat flexible circuit; and a second connector adapted for mating with said first connector and including a body member for positioning the flat flexible circuit thereon with the conductors of the circuit positioned for engaging said conductive terminals when the connectors are mated, wherein the body member includes integral locating pegs adapted to engage corresponding locating holes in the flat flexible circuit for locating the flexible circuit relative to the body member and a yieldable backing structure on the body member beneath the flexible circuit for resiliently biasing the conductors of the circuit against the terminals of the first connector.

14. The electrical connector assembly of claim 13 wherein said housing of said first connector includes an anvil portion at a front ledge thereof for rigidly backing the contact portions of the terminals.

15. The electrical connector assembly of claim 13 wherein said yieldable backing structure is a molded-in-place component.

16. The electrical connector assembly of claim 15 wherein said body member is molded of plastic material and said molded-in-place component is of an elastomeric material.

17. The electrical connector assembly of claim 16 wherein said molded-in-place component is of silicone rubber material.

18. The electrical connector assembly of claim 13, including latch means on the second connector for holding the second connector mated with the first connector.

19. The electrical connector assembly of claim 13 wherein said dielectric housing of the first connector is a multi-part assembly including at least a base part mounting the terminals and a cover part removably fixed to the base part wherein the base part and the cover part include complementary interengaging latch means to hold the base and cover parts in their fixed condition.

20. The electrical connector assembly of claim 19, wherein portions of the base part and cover part comprise a terminal position feature which allows the cover part to be fixed easily to the base part only when the terminals are correctly mounted in the base part.

* * * * *